United States Patent [19]

Kade et al.

[11] Patent Number: 4,877,486

[45] Date of Patent: Oct. 31, 1989

[54] HEADBOX FOR PAPER MACHINE WITH HOLLOW EXPANDING MEMBER FOR PROFILE BAR ADJUSTMENT

[75] Inventors: Werner Kade; Hermann Rahmig, both of Heidenheim, Fed. Rep. of Germany

[73] Assignee: J.M. Voith GmbH, Heidenheim, Fed. Rep. of Germany

[21] Appl. No.: 170,793

[22] Filed: Mar. 21, 1988

[30] Foreign Application Priority Data

Mar. 27, 1987 [DE] Fed. Rep. of Germany ..... 3710058

[51] Int. Cl.[4] ..... D21F 1/02

[52] U.S. Cl. ..... 162/336; 162/259; 162/344; 162/347

[58] Field of Search ..... 162/336, 344–347, 162/259, 262; 425/381, 466

[56] References Cited

U.S. PATENT DOCUMENTS

| | | | |
|---|---|---|---|
| 2,928,464 | 3/1960 | Western et al. | 162/347 |
| 3,233,575 | 2/1966 | Williams, Jr. | 162/347 |
| 3,976,539 | 8/1976 | Kirjavainen | 162/347 |
| 4,008,123 | 2/1977 | Kirjavainen | 162/347 |
| 4,326,916 | 4/1982 | Flaig et al. | 162/347 |
| 4,342,619 | 8/1982 | Gladh | 162/262 |
| 4,358,342 | 11/1982 | Nuttall | 162/347 |

FOREIGN PATENT DOCUMENTS

| | | |
|---|---|---|
| 1135744 | 8/1962 | Fed. Rep. of Germany . |
| 2529768 | 2/1976 | Fed. Rep. of Germany . |
| 2942966 | 4/1984 | Fed. Rep. of Germany . |
| 3535849 | 4/1987 | Fed. Rep. of Germany . |

*Primary Examiner*—Karen Hastings

*Attorney, Agent, or Firm*—Albert L. Jeffers; Richard L. Robinson

[57] ABSTRACT

A nozzle-like, machine-wide stock channel forms a stock discharge opening to which is allocated a device for adjusting the basis weight cross direction (CD) profile of the paper web produced in the paper machine. The device has a profile bar extending across the machine width. This is connected to an expanding member supported at the headbox in which are arranged pressure chambers disposed in succession across the machine width. By pressurization of the chambers of the expanding member consisting of an elastic material, this can be deformed. The deformation is transferred to the profile bar and in this way the effective width of the stock discharge opening changed.

24 Claims, 2 Drawing Sheets

Fig. 1
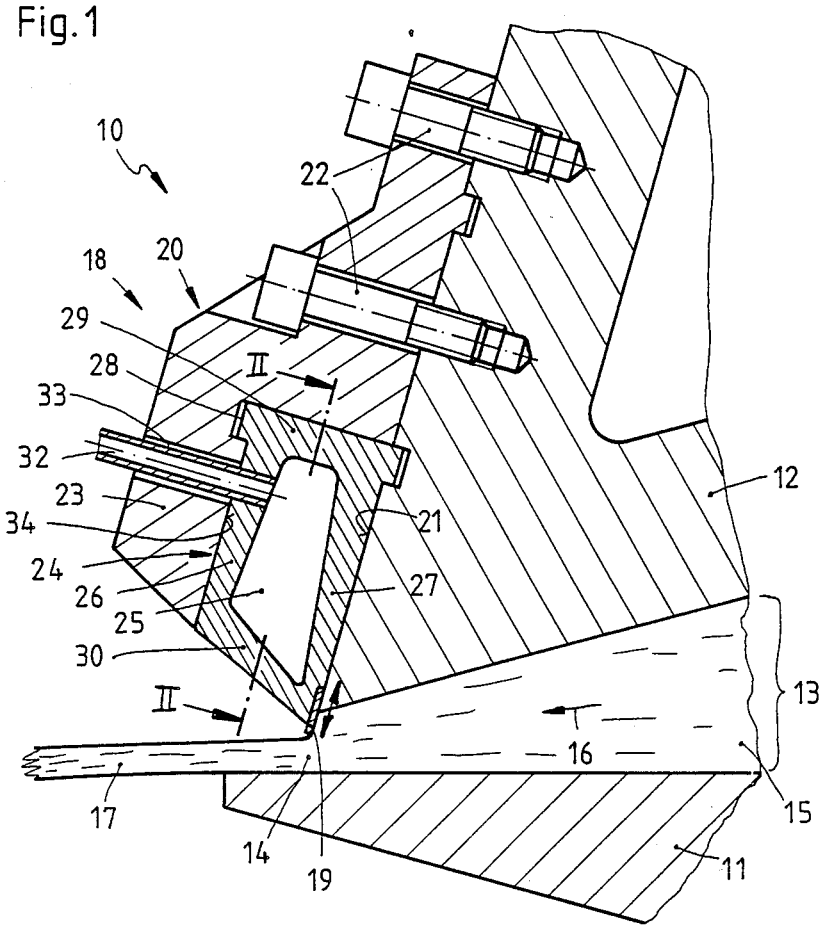
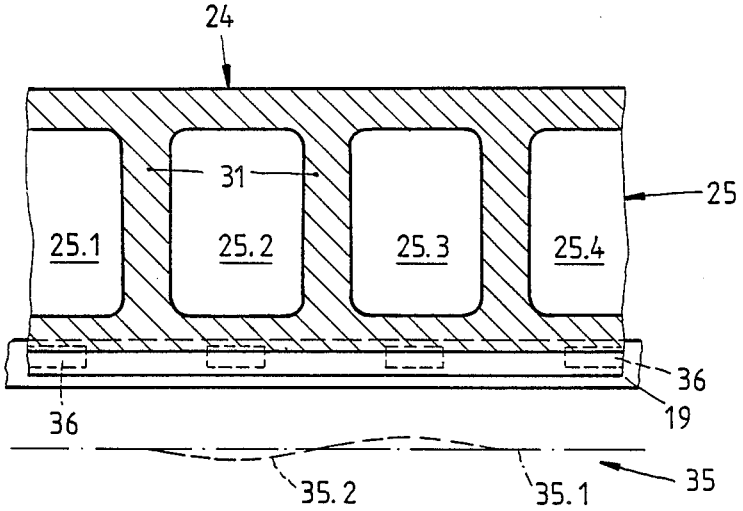
Fig. 2

HEADBOX FOR PAPER MACHINE WITH HOLLOW EXPANDING MEMBER FOR PROFILE BAR ADJUSTMENT

BACKGROUND OF THE INVENTION

The invention relates to a headbox for a paper machine or the like.

On a headbox known through DE-AS 1 135 744 (corresponding to U.S. Pat. No. 2,928,464), each flow guide wall is equipped with a means for adjusting the basis weight cross direction (CD) profile. This means is constructed in the form of a thin plate which limits the flow guide wall against the stock channel and extends freely beyond a supporting rib up to the stock discharge opening. Viewed in the direction of stock flow, the plate is supported on its rear side shortly ahead of the supporting rib on a plurality of bellows-shaped pressure chambers. These are arranged in close succession across the width of the machine and can be altered singly in their thickness by a pressure fluid. In this way it should be possible to reduce the effective width of the stock discharge opening by controlled lifting of the opening-side plate section from the flow guide wall. This known embodiment, however, is disadvantageous in so far as an increase in the thickness of one or more pressure chambers first of all causes the opening-side end section of the plate, upon which the stock stream impinges, to swivel about the rib, which rib acts as a swivel axis. This swivel movement causes, instead of the desired reduction of the effective width of the stock discharge opening, first of all the opposite effect: a widening of the opening. Only when the opening-side end section of the plate lifts from the rib is a reduction of the effective width of the stock discharge opening caused. There is then the risk that the end section of the plate unsupported in the direction of stock flow beyond the pressure chambers will be excited to vibration, which at least causes disturbances in the basis weight machine direction (MD) profile of the web.

DE-OS 25 29 768 (corresponding to U.S. Pat. No. 4,008,123) relates to a headbox with a machine-wide, movable flow guide wall which bears a profile bar for adjustment of the effective width of the stock discharge opening. Engaging at the two ends of the flow guide wall are force members constructed in the form of pneumatic bellows. These are supported on rigidly shaped parts of the headbox structure. The force members are intended to compensate for heat and load deflection of the flow guide wall. A correction of the deflection line of the flow guide wall achieved by the force members also acts on the profile bar. Inherently, this is undesired, as the adjustment of the profile bar orientates itself not on the deflection line of the flow guide wall but on the distance (width of opening) to the opposite fixed flow guide wall. The force members engaging the end faces of the movable flow guide wall would be completely insufficient for a correction of the profile bar adjustment because the high demands made on accuracy of the width of the stock discharge opening require an adjustability in small distances across the machine width.

DE-PS 29 42 966 (corresponding to U.S. Pat. No. 4,326,916) shows a headbox nozzle with a movable flow guide wall on whose opening-side end face a profile bar slidable approximately at right angles to the stock discharge opening is supported. In a machine-wide support member engaging the profile bar is inserted a pressurizable tube. This is supported on the side of the profile bar facing away from the end face of the flow guide wall. The purpose of this tube is to press the profile bar in respect of its load from the impinging stock flow against the movable flow guide wall. The tube can be disassembled into several sections to be able to exert a higher loading pressure at some points of the web width on the profile bar than in the other areas of the web width. An adjustment of the profile bar to set the width of the stock discharge opening is not the purpose of this known embodiment and also not possible because the direction of effect of the loading force exerted by the tube is at right angles to the direction of movement of the profile bar.

SUMMARY OF THE INVENTION

The task of the invention is to create a headbox of the type aforestated in which the equipment for adjustment of the basis weight cross direction (CD) profile is constructed to be operationally reliable, permits a defined influencing of the clear discharge width and consists of few components.

This problem is solved by the combination of features of the present invention.

The solution is advantageous in that through the two-sided guiding of the expanding members the connected profile bar follows a defined trajectory. The profile bar executes a deformation of the member parallel to the guiding and in the same direction of movement and to the same extent caused by pressurization of one pressure chamber or several pressure chambers. Furthermore, the uniting of the pressure chambers in one member produces favorable conditions for installation and fast exchange of this component. In addition, it is of significant advantage that the expanding member works with the proven profile bar, which is particularly suitable for basis weight correction and easily exchangeable in the event of damage.

Advantageous embodiments of the invention are described herein.

The material selected for the body of the unit, a plastic, preferably polyurethane, is particularly suitable for this application because it has a highly flexible strength, can be well formed by casting and is resistant to the paper stock and to wear.

The measure wherein the expanding member is supported with its one side wall at least indirectly against an end face of the movable flow guide wall running in the plane of the profile bar or parallel to this and is surrounded with its other side wall facing away from the profile bar by a detachably fastened holding bar at the flow guide wall provides good accessibility to the profile bar and member for maintenance purposes and the like.

With the dimensioning of the expanding member such that its height running parallel to the direction of movement of the profile bar is greater than its width, preferably double the width, during pressurizing at least one of the pressure chambers attains a deformation taking place predominantly and preferably in the direction of movement of the profile bar for the purpose of profile bar adjustment.

In order that the pressurization of a pressure chamber does not act in an undesired way on an adjacent chamber, according to a further aspect of the invention, the intermediate walls of the pressure chambers in the expanding member run at right angles to the profile bar and are stiffened against buckling, e.g. by an armoring embedded in the walls.

Through the measure wherein the expanding member has arranged therein in succession two rows of pressure chambers disposed in the same pitch in the direction of movement of the profile bar, namely under mutual offsetting of the pressure chambers of two rows in the longitudinal direction of the profile bar by one-half of a pitch distance, the section of the profile bar allocated to the intermediate area of two adjacent pressure chambers of one row can also be influenced by pressurization of the pressure chamber of the other row allocated to this area.

A further aspect of the invention in which the profile bar in the area of each pressure chamber is allocated a measuring unit recording the profile bar deformation, e.g. a strain gauge, is advantageous in so far as the profile bar deformation is measured immediately at the stock discharge opening, that is, at the location of profile bar action, so that tolerances and play of other components are largely ruled out. The deformation can then be used for control of the pressurization of the pressure chambers.

Embodiments of the invention are explained in greater detail below with the help of the drawing.

BRIEF DESCRIPTION OF THE DRAWINGS

FIG. 1 shows a cross-section through the outlet-side area of a headbox with one embodiment of an expanding member with a profile bar as equipment for the adjustment of the basis weight cross direction (CD) profile;

FIG. 2 shows a section along the line II—II in FIG. 1 through a section of the expanding member with a row of pressure chambers;

DESCRIPTION OF THE PREFERRED EMBODIMENTS

Figure 3:
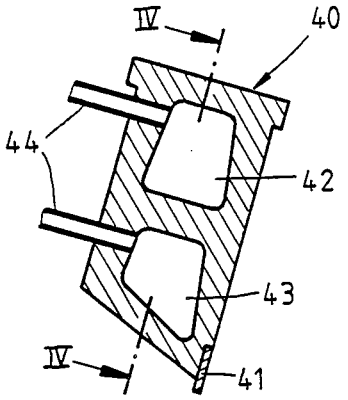
FIG. 3 shows a cross-section along the line III—III in FIG. 4 through another embodiment of an expanding member with two rows of pressure chambers.

A headbox 10 in FIG. 1 has a bottom, rigid flow guide wall 11 which extends across the machine width (perpendicularly to the drawing plane). The wall 11 is disposed opposite a second, machine-wide flow guide wall 12. The two flow guide walls 11 and 12 limit a nozzle-type, machine-wide stock channel 13, which goes over at the end side into a machine-wide stock discharge opening 14. The headbox 10 has the purpose of accelerating a stock suspension 15 fed at constant volume flow and constant solid content in the stock channel 13 in the direction of flow (arrow 16) and of discharging it onto a non-shown drainage wire of a paper machine in the form of a machine-wide stock jet 17 out of discharge opening 14.

The effective width of the stock discharge opening is adjustable by swivelling the movable flow guide wall 12 about an axis running parallel to the opening. Such an adjusting means is known by DE-OS 35 35 849. Furthermore, the movable flow guide wall 12 at the stock discharge opening 14 is equipped with a unit 18 for adjustment of the basis weight cross direction (CD) profile of the paper web produced in the paper machine. The unit 18 has a machine-wide element limiting the effective width of the stock discharge opening 14 as in the form of a profile bar 19. The profile bar 19 constructed as in the form of a sheet-metal strip is, as hereinafter described, adjustable relative to the movable stock guide wall 12, with the direction of movement being indicated by a double arrow.

The unit 18 for the adjustment of the basis weight cross direction (CD) profile has a holding bar 20 extending across the machine width, which is supported against a face end 21 of the movable flow guide wall 12 running in the plane of the profile bar 19 and attached to this with screws 22 so as to be detachable. The holding bar 20 has on the opening side a wall 23 running at a distance parallel to the face end 21 of the flow guide wall 12. This limits together with the face end 21 a space in which a machine-wide expanding member 24 of polyurethane is accommodated.

The expanding member 24 has a row of pressure chambers 25 (25.1 to 25.4 in FIG. 2) disposed consecutively across the machine width. On the opening side the expanding member 24 is connected to profile bar 19 at side wall 27. The connection between profile bar 19 and expanding member 24 can be constructed to be positive and/or non-positive.

The expanding member 24 has two side walls 26 and 27 running parallel to the direction of movement of the profile bar 19, which are supported against the wall 23 of the holding bar 20 and against the face end 21 of the movable flow guide wall 12 respectively. With its section 28 facing away from the profile bar, the expanding member 24 is held positively in the holding bar 20 and also in the flow guide wall 12, so that the wall 29 of the expanding member facing away from the profile bar rests firmly on the holding bar. On the opening side the side walls 26 and 27 of the expanding member 24 are connected to each other by a further end wall 30. The expanding member 24 is furthermore provided with intermediate walls 31 running at right angles to the profile bar 19, which separate the individual pressure chambers 25. Each individual pressure chamber 25 is allocated a nozzle 32 for connection of a pressure tube. Each tube nozzle 32 is embedded tightly into the side wall 26 of the expanding member 24 and penetrates with play a bore 33 in the wall 23 of the holding bar 20. The connection of the pressure chambers 25 to a pressure fluid (gas or liquid) can be done in the way as shown in the aforestated DE-AS 1 135 744.

Pressurization of a pressure chamber 25 with superatmospheric pressure causes a deformation of the flexible expanding member 24 in its area allocated to the chamber. To limit the deformation on this area, the intermediate walls 31 of the expanding member 24 are stiffened against buckling by an armoring 31.1. As the wall 29 facing away from the profile bar rests firmly on the holding bar 20, the pressurization causes a flexible expansion mainly of the side walls 26 and 27 of the expanding member 24 in the area which is allocated to the corresponding pressure chamber 25. The face end 21 of the flow guide wall 12 as well as the face end 34 of the wall 23 of the holding bar 20 serve as sliding surfaces for the disposed side walls 26 and 27 of the expanding member 24. The elastic deformation of the expanding member 24 thus acts at right angles to the longitudinal extension of the profile bar 19 in its direction of movement. The deformation in this direction of movement is assisted by the cross-sectional shaping of the expanding member 24 in that its height running parallel to the direction of movement is greater than its width, which in the present embodiment is double the width. To avoid, under the effect of the pressure fluid in the pressure chamber 25, a buckling of the opening-side wall 30, this wall can likewise be stiffened by an armoring 30.1 like the intermediate walls 31. This ensures that the profile bar 19 is not raised from the face end 21 of the flow guide wall 12 by the pressure of the stock suspension 15 in the stock channel 13.

FIG. 2 shows the effect of pressurization of the pressure chambers 25 on the profile bar 19 with the aid of bending lines 35 as an example. The expanding member 24 is dimensioned in its shaping such that a pressurization of all pressure chambers 25 with a "normal pressure" (e.g. ambient pressure) causes a deformation of the expanding member 24 and of the connected profile bar 19 to such an extent that the profile bar assumes a completely straight (chain) bending line 35.1. In this case, therefore, the profile bar 19 runs parallel to the rigid flow guide wall 11 and produces a stock discharge opening 14 of the same width.

Deviations from the predetermined basis weight cross direction (CD) profile of the paper web can be compensated for by pressurization of corresponding pressure chambers 25 with a pressure deviating from the "normal pressure" as follows: if, for example, it is found that a web strip allocated to pressure chamber 25.2 has too high a basis weight, a web strip allocated to pressure chamber 25.3, on the other hand, has too low a basis weight, then the pressure chamber 25.2 is pressurized with a higher pressure and pressure chamber 25.3 with a lower pressure (i.e., if necessary, vacuum) than the "normal pressure". This leads to a deformation of the expanding member 24 and of the profile bar 19 in the corresponding area so that a (broken) bending line 35.2 sets in. The effective width of the stock discharge opening 14 is therefore reduced in the area of pressure chamber 25.2, but enlarged in the area of pressure chamber 25.3. Consequently, the volume of the stock suspension 15 fed to the respective web strip and thus the basis weight cross direction (CD) profile is corrected.

Through the arrangement of the pressure chambers 25 in a pitch distance of, for example, 50 mm, the influencing of the basis weight cross direction (CD) profile can be done within very close limits in relation to the web width. In order that the dimension of the profile bar deformation can be recorded and fed to a control circuit for the adjustment of the effective width of the stock discharge opening 14, the profile bar 19 is connected in the area of each pressure chamber 25 to a measuring device in the form of a strain gauge 36.

Figure 4:
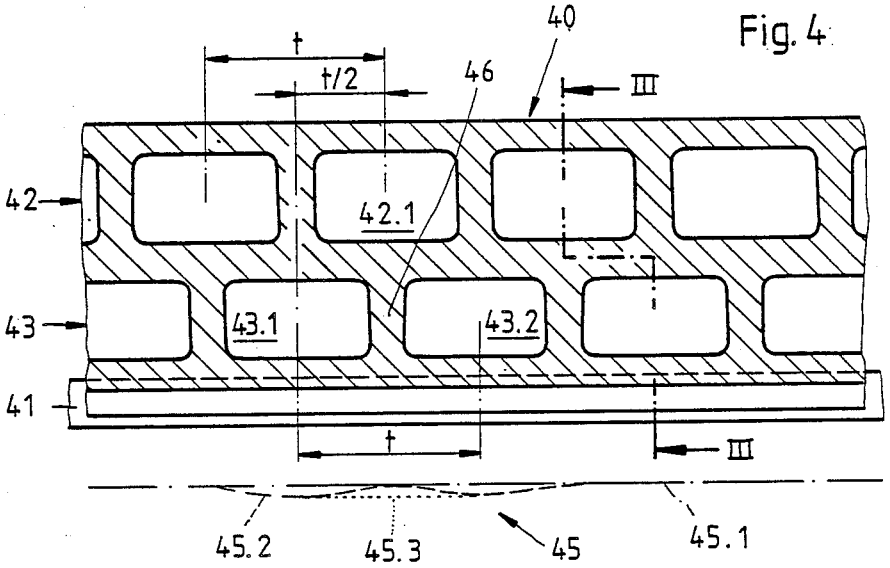
FIG. 4 shows a section along the line IV—IV in FIG. 3 through the expanding member.

The further embodiment of expanding member 40 shown in FIGS. 3 and 4 differs from those according to FIGS. 1 and 2 mainly in that two rows of pressure chambers 42 and 43 are disposed in the direction of movement of the profile bar 41. The pressure chambers 42 and 43 of each row are arranged in the same pitch t across the machine width. Each pressure chamber 42, 43 is connected with a tube nozzle 44 for connection to a pressure source.

The pitch t of the pressure chambers 42 or 43 of each row 10 may be 50 mm. As can be seen from FIG. 4, the pressure chambers 42, 43 of the two rows are mutually offset in the longitudinal direction of the profile bar by one-half of the pitch distance (t/2). Viewed across the machine width, open pressure chamber 42 or 43 each can thus be used at a distance of 25 mm each for application at the profile bar 41. To make this clear, bending lines 45 are shown underneath the profile bar 41 in FIG. 4. The bending line 45.1 (the chain line) represents the case if all pressure chambers 42 and 43 of the two rows are pressurized with "normal pressure". The "broken" bending line 45.2 of the profile bar 41 is reached if the pressure chambers 43.1 and 43.2 of the profile bar-side row deform the expanding member 40 with a higher pressure than "normal pressure". By pressurization of the pressure chamber 42.1 of the other row with also higher pressure than "normal pressure", the area of the expanding member 40, in which an intermediate wall 46 lies between the pressure chambers 43.1 and 43.2, can also be deformed and thus the profile bar 41 given (dotted) bending line 45.3 in this area. Bending lines of the profile bar 41 lying on the other side of the straight line 45.1 can be achieved by pressurization of the corresponding pressure chambers 42 and 43 with a pressure below the "normal pressure".

What is claimed is:

1. Headbox for a paper machine for producing a paper web, comprising:

a first machine-wide flow guide wall;

a second machine-wide flow guide wall disposed opposite said first flow guide wall and movable relative thereto;

said first and second flow guide walls defining therebetween a nozzle-like, machinewide stock channel having a machine-wide stock discharge opening;

said second flow guide of wall having means connected thereto proximate the stock discharge opening for adjusting the basis weight cross direction profile of the paper web produced in the paper machine, said means for adjusting including a machine-wide profile bar limiting the effective width of the stock discharge opening and being adjustable relative to said second flow guide wall;

a hollow expanding member extending across the machine width having pressure chambers separated by intermediate walls arranged in succession across the machine width, which pressure chambers are supported against said second flow guide wall and can be pressurized independently of one another with a pressure fluid, the pressure chambers of said hollow expanding member having sidewalls oriented parallel to the direction of movement of the profile bar on the stock flow opening side of the sidewalls, the sidewalls being composed of a material of high elasticity, the pressure chambers further including an end wall facing the stock discharge opening and connecting the sidewalls to one another, the end wall being stiffened by an armoring to avoid buckling;

said expanding member being guided parallel to the direction of movement of the profile bar on both sidewalls between planar sliding surfaces connected at least indirectly to said second flow guide wall, being fastened at a section thereof facing away from the profile bar at least indirectly to said second flow guide wall, and being connected at one of the sidewalls with the profile bar proximate the stock discharge opening, the profile bar being guided by one of said planar sliding surfaces corresponding to said one of the sidewalls such that the profile bar is moved by a flexible expansion of said one of the sidewalls running in the plane of aid one of said planar sliding surfaces.

2. Headbox according to claim 1, in which the expanding member is composed of a plastic.

3. Headbox according to claim 2, in which the plastic is polyurethane.

4. Headbox according to claim 1, in which the expanding member is supported with one side wall at least indirectly against an end face of said second flow guide wall oriented in a plane parallel to the pane of the profile bar and the other side wall as well as the section facing away from the profile bar are surrounded by a holding bar detechably fastened at said second flow guide wall.

5. Headbox according to claim 1, in which the height of the expanding member parallel to the direction of movement of the profile bar is greater than the width of the expanding member.

6. Headbox according to claim 5, in which the height of the expanding member is double the width of the expanding member.

7. Headbox according to claim 1, in which the intermediate walls of the pressure chambers in the expanding member are oriented at right angles to the profile bar and are stiff against buckling.

8. Headbox according to claim 1, in which two rows of pressure chambers are arranged in succession in the expanding member in the direction of movement of the profile bar and are disposed in like pitch, by mutual offsetting of the pressure chambers of the two rows in the longitudinal direction of the profile bar by one-half of a pitch distance.

9. Headbox according to claim 1, in which the profile bar in the area of each pressure chamber is allocated a measuring means for recording the profile bar deformation.

10. Headbox according to claim 9, in which the measuring means includes a strain gauge.

11. Headbox according to claim 2, in which the height of the expanding member parallel to the direction of movement of the profile bar is greater than the width of the expanding member.

12. Headbox according to claim 2, in which the intermediate walls of the pressure chambers in the expanding member are oriented at right angles to the profile bar and are stiff against buckling.

13. Headbox according to claim 4, in which the intermediate walls of the pressure chambers in the expanding member are oriented at right angles to the profile bar and are stiff against buckling.

14. Headbox according to claim 5, in which the intermediate walls of the pressure chambers in the expanding member are oriented at right angles to the profile bar and are stiff against buckling.

15. Headbox according to claim 2, in which two rows of pressure chambers are arranged in succession in the expanding member in the direction of movement of the profile bar and are disposed in like pitch, by mutual offsetting of the pressure chambers of the two rows in the longitudinal direction of the profile bar by one-half of a pitch distance.

16. Headbox according to claim 4, in which two rows of pressure chambers are arranged in succession in the expanding member in the direction of movement of the profile bar and are disposed in like pitch, by mutual offsetting of the pressure chambers of the two rows in the longitudinal direction of the profile bar by one-half of a pitch distance.

17. Headbox according to claim 5, in which two rows of pressure chambers are arranged in succession in the expanding member in the direction of movement of the profile bar and are disposed in like pitch, by mutual offsetting of the pressure chambers of the two rows in the longitudinal direction of the profile bar by one-half of a pitch distance.

18. Headbox according to claim 7, in which two rows of pressure chambers are arranged in succession in the expanding member in the direction of movement of the profile bar and are disposed in like pitch, by mutual offsetting of the pressure chambers of the two rows in the longitudinal direction of the profile bar by one-half of a pitch distance.

19. Headbox according to claim 2, in which the profile bar in the area of each pressure chamber is allocated a measuring means for recording the profile bar deformation.

20. Headbox according to claim 4, in which the profile bar in the area of each pressure chamber is allocated a measuring means for recording the profile bar deformation.

21. Headbox according to claim 5, in which the profile bar in the area of each pressure chamber is allocated a measuring means for recording the profile bar deformation.

22. Headbox according to claim 6, in which the profile bar in the area of each pressure chamber is allocated a measuring means for recording the profile bar deformation.

23. Headbox according to claim 7, in which the profile bar in the area of each pressure chamber is allocated a measuring means for recording the profile bar deformation.

24. Headbox according to claim 8, in which the profile bar in the area of each pressure chamber is allocated a measuring means for recording the profile bar deformation.

* * * * *